US009776767B2

(12) United States Patent
DeJesus et al.

(10) Patent No.: US 9,776,767 B2
(45) Date of Patent: Oct. 3, 2017

(54) PACKAGING SYSTEM AND METHOD

(71) Applicant: THIRD DIMENSION, INC., Geneva, OH (US)

(72) Inventors: Louis G. DeJesus, Geneva, OH (US); Doug Dean, Geneva, OH (US)

(73) Assignee: Third Dimension, Inc., Geneva, OH (US)

( * ) Notice: Subject to any disclaimer, the term of this patent is extended or adjusted under 35 U.S.C. 154(b) by 643 days.

(21) Appl. No.: 14/305,748

(22) Filed: Jun. 16, 2014

(65) Prior Publication Data

US 2014/0353199 A1 Dec. 4, 2014

Related U.S. Application Data

(63) Continuation-in-part of application No. 12/406,436, filed on Mar. 18, 2009, now Pat. No. 8,752,703.

(51) Int. Cl.

| | |
|---|---|
| ***B65D 23/10*** | (2006.01) |
| ***B65D 25/10*** | (2006.01) |
| ***B65D 85/48*** | (2006.01) |
| ***B65B 23/20*** | (2006.01) |
| ***B65D 81/05*** | (2006.01) |
| ***B65D 81/107*** | (2006.01) |
| ***B65D 5/50*** | (2006.01) |

(52) U.S. Cl.

CPC ..... *B65D 25/105* (2013.01); *B65B 23/20* (2013.01); *B65D 5/509* (2013.01); *B65D 5/5088* (2013.01); *B65D 81/055* (2013.01); *B65D 81/1075* (2013.01); *B65D 85/48* (2013.01)

(58) Field of Classification Search

CPC .... B65D 25/105; B65D 23/20; B65D 5/5088; B65D 5/509; B65D 81/0551

USPC ..... 206/583, 523, 586, 806, 592, 453

See application file for complete search history.

(56) References Cited

U.S. PATENT DOCUMENTS

| | | | | | |
|---|---|---|---|---|---|
| 3,339,722 | A * | 9/1967 | Van Antwerpen | B65D 85/48 | 206/453 |
| 4,241,832 | A | 12/1980 | Bliss | | |
| 4,339,039 | A | 7/1982 | Mykleby | | |
| 4,443,508 | A | 4/1984 | Mehl | | |
| 4,750,609 | A | 6/1988 | Felis | | |
| 5,328,156 | A | 7/1994 | Hoke | | |
| 5,522,539 | A * | 6/1996 | Bazany | B65D 5/5088 | 206/523 |
| 6,004,424 | A * | 12/1999 | Faust | B65B 51/067 | 156/264 |
| 6,055,992 | A * | 5/2000 | Skarne | A45C 11/00 | 132/293 |

(Continued)

OTHER PUBLICATIONS

International Search Report for International Application No. PCT/US2010/027817 dated May 26, 2010.

*Primary Examiner* — King M Chu

(74) *Attorney, Agent, or Firm* — Ward Law Office LLC; Jacob M. Ward

(57) ABSTRACT

A packaging combination is disclosed that includes a box and at least first and second planar objects in the box. At least first and second shock absorbing clips are attached to the planar objects in the box. At least one of the first clips is fastened to the first planar object and the clip is positioned between one wall of the box and the second planar object. At least one of the second clips is fastened to both planar objects and is positioned between opposite walls of the box.

22 Claims, 13 Drawing Sheets

(56) References Cited

U.S. PATENT DOCUMENTS

| | | | | |
|---|---|---|---|---|
| 7,296,681 | B2 | 11/2007 | McDonald et al. | |
| 2002/0134822 | A1* | 9/2002 | Mills | B65D 5/2076 229/103.3 |
| 2007/0205116 | A1* | 9/2007 | Wu | A61C 19/00 206/83 |

* cited by examiner

PACKAGING SYSTEM AND METHOD

RELATED APPLICATIONS

This is a continuation in part of Ser. No. 12/406,436 filed Mar. 18, 2009, and now U.S. Pat. No. 8,752,703.

BACKGROUND

The present disclosure relates to a packaging system and method, and more particularly relates to an improved packaging system and method for shipping and handling of all types of doors, glass doors, doors with glass inserts, mirrors, framed art, etc.

Protective packaging is often used to protect products or articles from shocks and impacts during shipping or transportation. For example, when transporting articles that are relatively fragile and/or valuable, it is often desirable to cushion the article inside a box to protect the article from a physical impact with the inner walls of the box that might be caused by shocks imparted to the box during loading, transit, unloading, etc.

Often times, some additional structure is used to keep the article from moving uncontrollably within the box. Such additional structures can include paper or plastic packaging materials, structured plastic foams, foam-filled cushions, and the like. In some instances, the article to be packaged is suspended within the box so as to be spaced from at least some of the walls of the box, thus protecting the article from other foreign objects which may impact or compromise the outer walls of the box.

Items or articles that are sometimes shipped in this manner include doors, such as cabinet doors, which can be formed of glass or with glass inserts, mirrors, framed art, etc. One prior art shipping container includes a relatively thin rectangular box which receives the suspended shipping item between a pair of large foam sheets. Frame members can be disposed along upper and lower ends of the box and/or right and left side ends of the box. Typically the box requires the application of an adhesive, such as glue, at multiple locations to secure the box in a closed position with the product to be shipped interposed between the foam sheets within an opening defined by the frame members.

A major drawback of this type of shipping arrangement is the cost of materials required for each item to be shipped. Other drawbacks include increased shipping weight due to the large foam sheets and the frame members. Also, the item being shipped is prone to movement or migration within the box, particularly migration toward one of the ends (e.g., upper or lower ends) of the box. This can be reduced or eliminated by exact sizing of the box, the frame members and the foam sheets to correspond to the item being shipped, but then a large inventory of boxes, frame members and foam sheets is required to accommodate varying sizes of items being shipped.

As another issue, many cushioning packaging structures and techniques are designed in a manner that limits their use to single items. Although this is fine in many circumstances, in other situations similar items that are nevertheless of different sizes (e.g., two sizes of cabinet doors) require separate, differently sized containers and cushions. This increases complexity (and thus cost) and reduces packaging efficiency.

SUMMARY

According to one aspect, an improved packaging method is provided for a product. More particularly, in accordance with this aspect, a shipping container appropriately sized for the product is provided. At least one shock absorption member is attached to the shipping container for serving as a locator for the product relative to the shipping container. The product is positioned on the shipping container with the at least one shock absorption member. At least another shock absorption member is attached to the shipping container to secure the product on the shipping container. The shipping container is closed about the product with the shock absorption members suspending the product within the enclosed shipping container.

According to another aspect, an improved packaging system is provided for a product. More particularly, and in accordance with this aspect, the packaging system includes a shipping container appropriately sized for the product and at least a first shock absorption member attached to the shipping container for serving as a locator for the product and for positioning the product on the shipping container. The packaging system further includes at least a second shock absorption member attached to the shipping container for, together with the at least a first shock absorption member, securing the product on the shipping container. The product is suspended by the at least a first shock absorption member and the at least a second shock absorption member within the shipping container when the shipping container is closed about the product for shipping.

According to still another aspect, an improved packaging method is provided for securing a product within a shipping container. More particularly, in accordance with this aspect, a first shock absorption clip is attached to the shipping container for positioning the product relative to the shipping container. The product is installed onto the shipping container. A second shock absorption clip is attached to the shipping container for securing the product relative to the shipping container. The shipping container is assembled about the product with the first and second shock absorption clips suspending the product within the shipping container.

In another aspect, the invention is the combination of a box; at least first and second planar objects in the box; and at least first and second shock absorbing (foam) clips attached to the planar objects in the box. At least one of the first clips is fastened to the first planar object and the clip is positioned between one wall of the box and the second planar object. A least one of the second clips is fastened to both planar objects and is positioned between opposite walls of the box.

In another aspect, the invention is a package precursor that includes a box blank; a first C-shape clip fixed on one panel of the box blank; and at least one E-shaped clip fixed on the same panel of the box blank. A first planar object is inserted into the E-shaped clip and the C-shape clip; and a second planar object is inserted into the E-shape clip and a second C-shape clip, with the second C-shape clip gripping the first planar object.

In another aspect, the invention is a cushioning clip formed of a resilient material. The cushioning clip has a base wall and three clamping walls oriented generally perpendicularly to the base wall. The clamping walls form two exterior clamping walls and one interior clamping wall and defining two gripping slots between the respective exterior clamping walls and the interior clamping wall. An adhesive strip is positioned along one of the exterior clamping walls immediately adjacent the base wall.

In yet another aspect, the invention is a packaging station. The packaging station includes an elevated horizontal work surface and a switch-based taping machine substantially coplanar with the work surface so that packages on the work surface can engage the switch without requiring lifting the packages from the work surface. A supply container is mounted on one edge of the horizontal work surface; and a tape dispenser is adjacent the supply container. Packages assembled on the horizontal work surface can include items from the supply container taped inside the packages and the exterior of packages can be taped by moving a package against the switch-based taping machine and without lifting the package.

The foregoing and other objects and advantages of the invention and the manner in which the same are accomplished will become clearer based on the followed detailed description taken in conjunction with the accompanying drawings.

DETAILED DESCRIPTION

Figure 1:
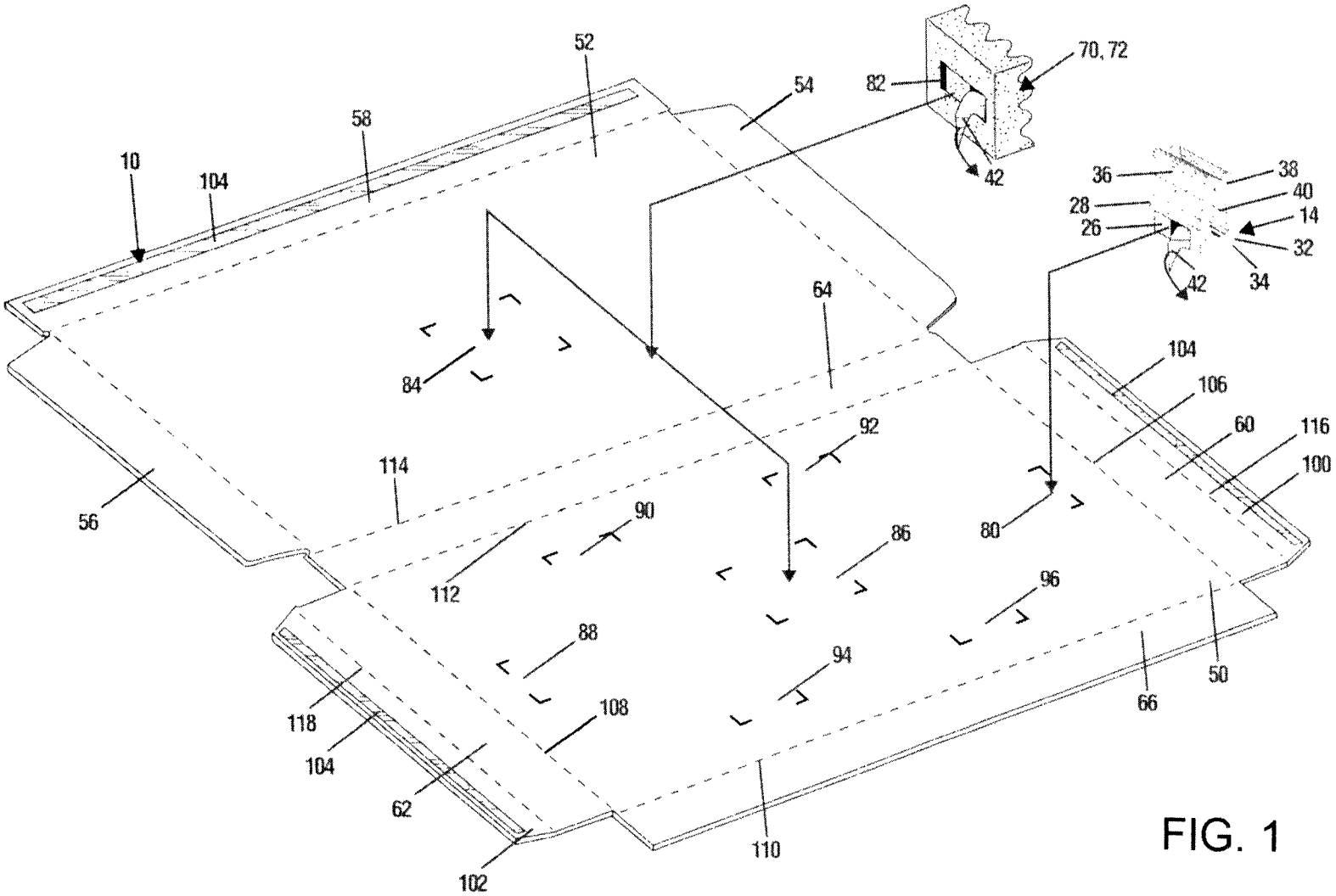
FIG. 1 is perspective view of a shipping container prior to folding showing a shock absorption member and one or more foam pads being attached to the shipping container.

Referring now to the drawings, wherein the showing are for purposes of illustrating one or more exemplary embodiments, FIGS. 1-6 illustrate a packaging system for a product, such as a door or a cabinet door, which can include a glass portion or insert, or alternatively the product can be a mirror, framed art, etc. The packaging system includes a shipping container 10, which can be appropriately sized for the product that it is to be shipped (e.g., cabinet door 12 shown in FIGS. 3-6). The packaging system further includes at least a first shock absorption clip or member, such as shock absorption clip or member 14, attached to the shipping container 10 for serving as a locator for the product 12 and for positioning the product 12 on the shipping container 10. In addition, the packaging system includes at least a second shock absorption clip or member (e.g., shock absorption member 16) that is attached to the shipping container 10 for, together with the at least a first shock absorption member, securing the product 12 on the shipping container 10.

Figure 6:
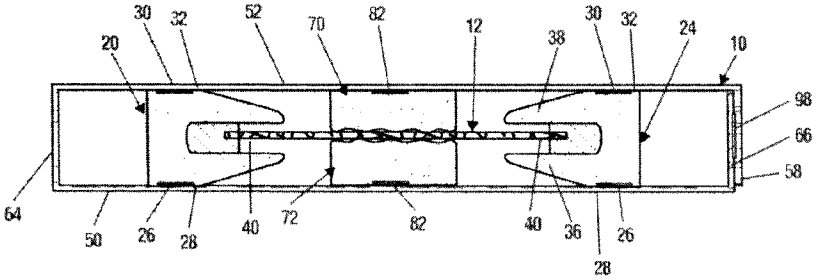
FIG. 6 is a cross-sectional view of the shipping container taken through the line 6-6 of FIG. 5.

In the illustrated embodiment, shock absorption member 14 is alone attached to the shipping container 10 for serving as the locator for the product 12 and for positioning the product 12 on the shipping container 10, and shock absorption member 16, along with shock absorption clips or members 18, 20, 22, 24, are attached to the shipping container 10 for securing the products 12 on the shipping container 10 together with the shock absorption member 14. That is, the shock absorption member 14 locates and positions the product 12 on the shipping container 10, while all of the illustrated shock absorption members 14-24 secure the product 12 on the shipping container 10. It will be appreciated by those skilled in the art that more than a single shock absorption member, such as member 14, can be used for locating the product 12 on the shipping container 10 and for positioning the product 12 on the shipping container 10. Likewise, the number of shock absorption members securing the product 12 on the shipping container 10 can vary from the illustrated embodiment (e.g., more or fewer shock absorption members can be used to secure the product 12 on the shipping container 10). As will be described in more detail below, and as best illustrated in FIG. 6, the product 12 (a cabinet door in the illustrated embodiment) is suspended by the shock absorption members 14-24 within the shipping container 10 when the shipping container is closed about the product 12 for shipping.

Figure 7:
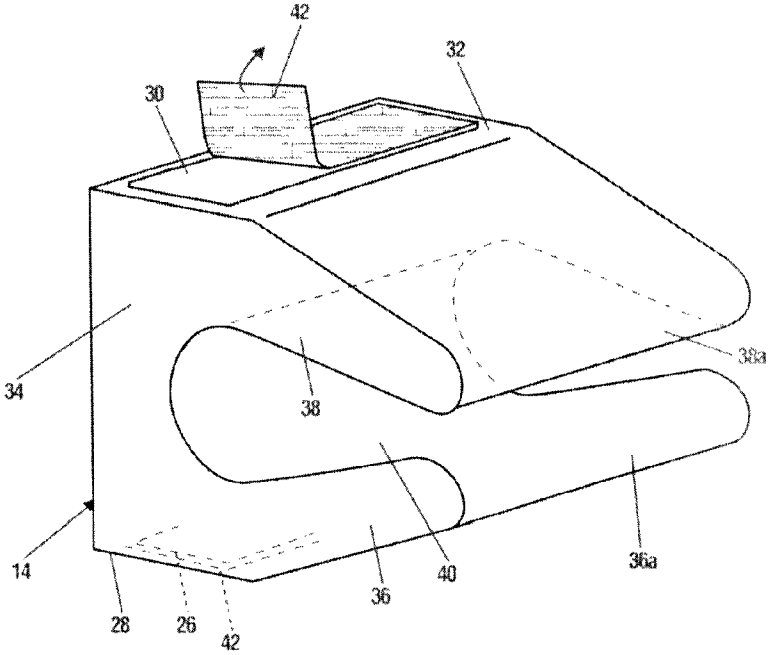
FIG. 7 is a perspective view of one of the shock absorption members.

The shock absorption members 14-24 can be extruded polyethylene, though other materials could also be used. Structurally, all the shock absorption members can be similarly constructed; accordingly, only shock absorption member 14 will be described in further detail herein, but its description is applicable to the other shock absorption members 16-24. The shock absorption member 14 is attached to the shipping container by at least one adhesive strip. More specifically, and with specific reference to FIG. 7, the shock absorption member 14 includes a first adhesive strip 26 disposed on a first side 28 and a second adhesive strip 30 disposed on a second, opposite side 32.

As shown, the shock absorption member 14 includes a base wall 34 and a pair of clamping walls 36, 38 extending from spaced apart locations of the base wall 34 to form a slot 40 therebetween and into which the product 12 can be received for securement thereof. In the illustrated shock absorption member 14, the clamping walls 36, 38 converged toward one another as the walls 36, 38 extend away from the base wall 34. That is, the slot 40 defined between the converging walls 36, 38 is wider adjacent the base wall 34 than adjacent distal ends 36*a*, 38*a* of the converging walls. The first side 28 on which the first adhesive strip 26 is provided is defined by the clamping wall 36. Likewise, the second side 32 to which the second adhesive strip 30 is attached is defined by the clamping wall 38. As will be described in further detail below, the first adhesive strip 26 on the first side 28 allows the shock absorption member 14 to be attached to the shipping container 10, whereas the second adhesive strip 30 on the second side 32 allows the shipping container 10 to be attached to the shock absorption member 14 when the shipping container is folded into a box about the product 12. Each of the adhesive strips 26, 30 can have a peelable liner 42 disposed thereon to prevent the adhesive strips from inadvertently adhering to an undesirable object and/or location.

Figure 8:
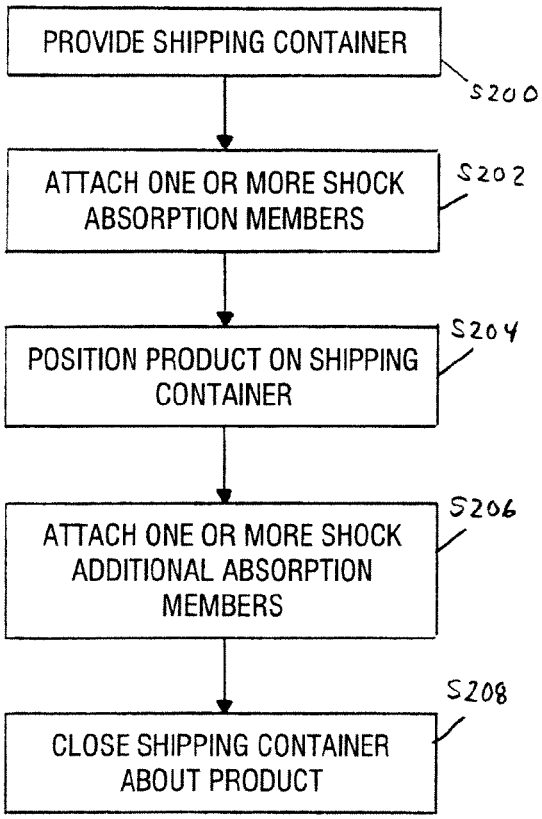
FIG. 8 is a block diagram illustrating a packaging method.

With additional reference to FIG. 8, a packaging method for a product, and particularly for securing a product within a shipping container, will now be described. In step S200, a shipping container, such as shipping container 10 is provided. Shipping container 10 can be appropriately sized for the product that is to be shipped thereby. For example, the illustrated shipping container 10 is sized relative to the illustrated product 12 so that the product 12 is fully received within the shipping container 10 when in its folded state shown in FIGS. 5 and 6. Unlike some prior art packaging systems and shipping containers, the shipping container 10 may not be exactly sized relative to the product to be shipped therein. Accordingly, a few shipping containers 10 of varying sizes can be maintained in inventory to ship a variety of product sizes. In one embodiment, the shipping container 10 is a cardboard box container, and optionally can be formed by 100% recycled materials, though this is not required.

As best shown in FIG. 1, the shipping container 10 can be formed from a single sheet of material. In particular, the shipping container 10 can include a first main section 50, which will be disposed adjacent one side of the product 12, and a second main section 52, which will be disposed adjacent a second side of the product 12. The second section 52 can include end tabs 54, 56 and side tab 58. The tabs 54,56,58 can be separated from the main section 52 by fold lines, score lines or the like as is known and understood by those skilled in the art. The first main section can similarly include end tabs 60,62 and side tabs 64,66. These tabs 60-66 can be separated from the first main section 50 by fold lines, score lines or the like. As will be described in further detail below, the end tabs 60, 62 are configured to overlap the end tabs 54, 56 when the shipping container 10 is folded about the product 12. In this manner, the tabs 54, 60 will form a first end of the shipping container 10 and the tabs 56,62 will form a second end of the shipping container 10. The tab 64 will form a first side end of the shipping container 10 and the tabs 58, 66 together will form a second side end of the shipping container 10.

The next step (S202) in the packaging method is to attach at least one or a first shock absorption member to the shipping container 10 for serving as a locator for the product 12 relative to the shipping container 10. In the illustrated embodiment, as shown in FIG. 1, step S202 specifically includes attachment of the shock absorption member 14 to the shipping container at location 80 for positioning the product 12 relative to the shipping container 10. It is to be appreciated that additional shock absorption members, such as any one or more of illustrated shock absorption members 16-24, or some other shock absorption member(s), could also be attached to the shipping container 10 in step S202 for serving as locators for the product 12 relative the shipping container 10, if desired.

In addition to attaching to shock absorption member 14 to the shipping container 10, one or more foam pads can be attached to the shipping container 10. Specifically, as shown in the illustrated embodiment, foam pads 70, 72 can be respectively attached at locations 84, 86 to the first and second main sections 50,52, which respectively form first and second sides of the box when the shipping container 10 is folded into its box form. As will be described in more detail below, the foam pads 70, 72 are positioned or interposed between the sides 50, 52 of the shipping container 10 and the product 12 carried within the shipping container 10. The foam pad 70, 72 can be formed by polyester foam, though this is not required.

Figure 2:
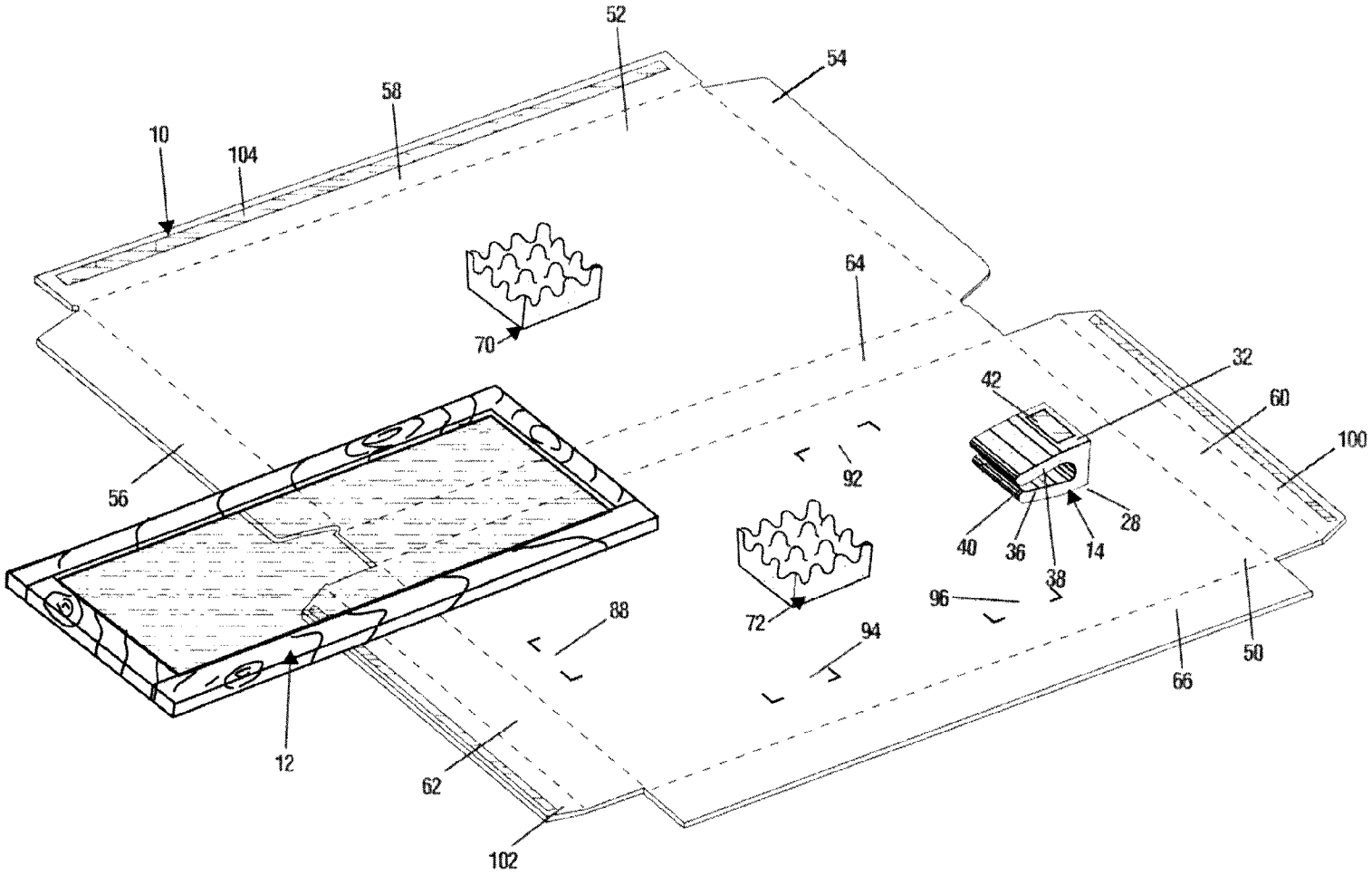
FIG. 2 is a perspective view of the shipping container of FIG. 1, showing a product, such as a cabinet door with a glass insert, being positioned on the shipping container by receipt of one edge of the product within a slot defined by the shock absorption member.

Next, with reference to FIG. 2, the product 12 can be positioned or installed in step S204 on or onto the shipping container 10 with or by the at least one shock absorption member (e.g., member 14) that was attached to the shipping container 10 in step S202. Positioning or installing the product 12 on the shipping container 10 in step S204 includes inserting the product 12 into the slot 40 defined by the shock absorption member 14 (or slots of each shock absorption member if multiple shock absorbers are applied in step S202).

Figure 3:
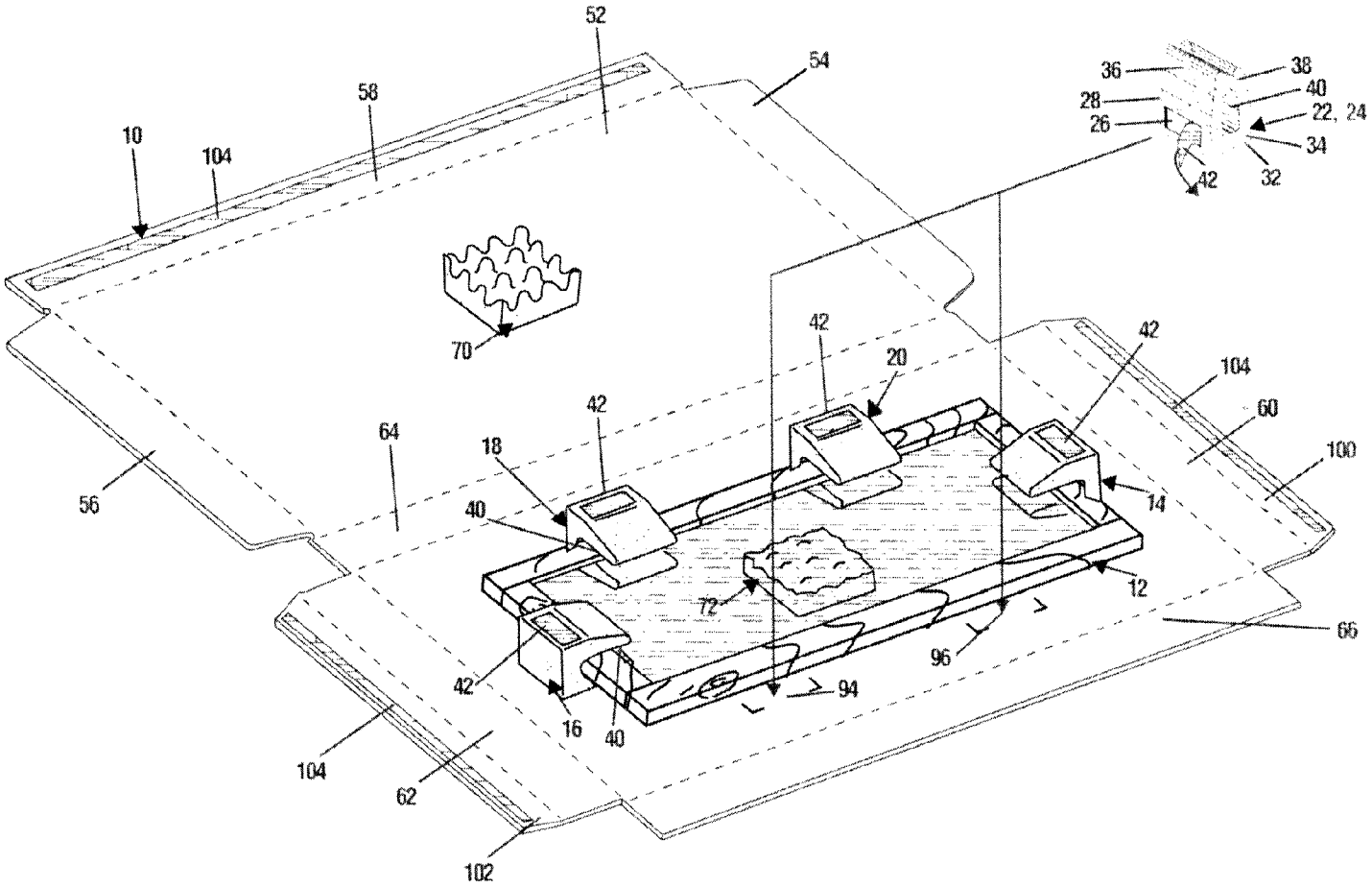
FIG. 3 is perspective view of the shipping container of FIG. 2 showing additional shock absorption members being attached to the shipping container to secure the product thereon.
Figure 4:
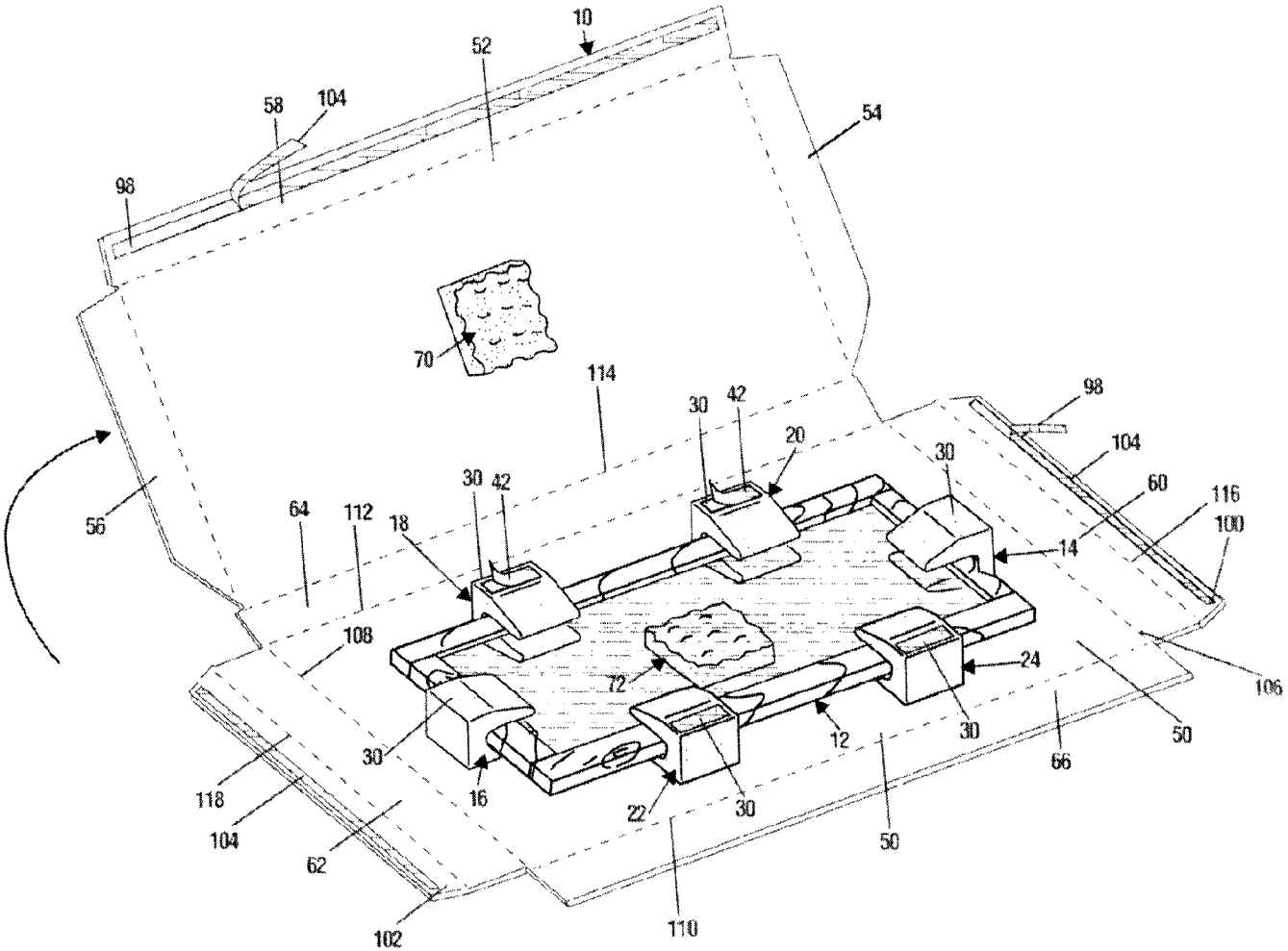
FIG. 4 is a perspective view of the shipping container of FIG. 3 showing the shipping container being closed about the product with the shock absorption members suspending the product.

With the product 12 positioned or installed on the shipping container 10, at least another or a second shock absorption member is attached to the shipping container 10 in step S206 for securing the product 12 relative to the shipping container 10. In the illustrated embodiment, with reference to FIG. 3, step S206 can include attachment of the shock absorption members 16-24 respectively to the shipping container 10 at respective locations 88, 90, 92, 94, 96 to secure the products 12 on the shipping container 10. In particular, step S206 includes positioning each of the shock absorption members 16-24 on the shipping container 10 such that the product 12 is received within slots 40 defined in each of the shock absorption members 16-24. As best shown in FIG. 3, when the product 12 is installed onto the shipping container 10 and secured thereto by the additional shock absorption members 16-24, an underside of the product 12 rests against the foam pad 72. If desired, the locations 80 and 84-96 can be marked on the shipping container 10 by appropriate indicia as shown in the illustrated embodiment or other markings could be used (e.g., scoring).

Figure 9:
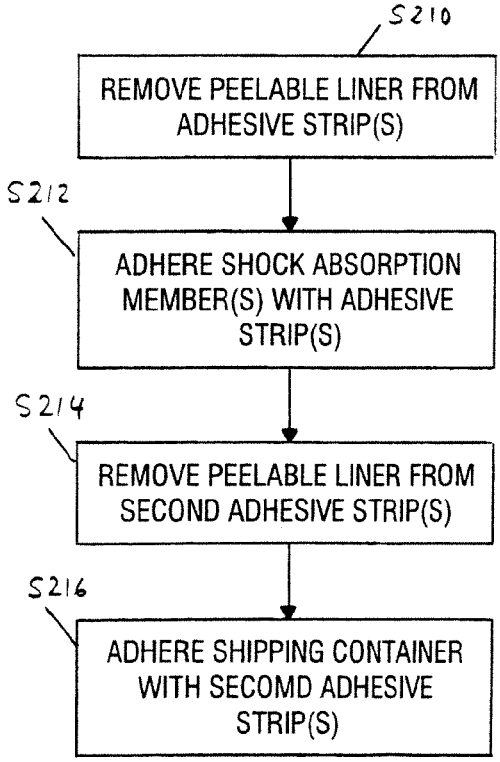
FIG. 9 is a block diagram illustrating further steps of the packaging method of FIG. 8.

The steps S202 and S206 of attaching the shock absorption members 14-24 to the shipping container 10 can include removing the peelable liners 42 from the adhesive strips 26, 30 of the shock absorption members 14-24 and adhering each of the shock absorption members 14-24 to the shipping container 10 via the adhesive strips 26, 30. Adhering each of the shock absorption members 14-24 to the shipping container 10 can include installing each member 14-24 at respective locations 80, 88, 90, 92, 94, 96 on the shipping container. Specifically, as shown in FIG. 9, the removable liner 42 of the lower adhesive strip 26 can be removed (S210) and the shock absorption member 14 can be adhered to the shipping container at location 80 as shown in FIG. 1 (S212). If the foam pads 70,72 are used, peelable liner 42 on adhesive strip 82 of the foam pads 70,72 can be removed and the foam pads 70,72 adhered to the shipping container 10 at respective locations 84,86. This results in foam pad 72 being disposed (or interposed) between an underside of the cabinet 12 and the first main section 50 of the shipping container 10. These same steps S210, S212 can be performed when attaching the shock absorption members 16-24 to the shipping container 10 at locations 88-96, as shown in FIG. 3.

Similarly, before closing the shipping container 10 about the product 12, peelable liners 42 can be removed from the second adhesive strips 30 disposed on the second sides 32 of the shock absorption members 14-24 (S214). Accordingly, when the shipping container is closed or assembled about the product 12, the shipping container 10 is adhered to the shock absorption member 14-24 via their respective adhesive strips 30 (S216). When the shipping container 10 is folded into a box about the product 12 and adhered to the shock absorption members 14-24, the foam pad 70 rests against an upper surface of the product 12 and is interposed between the product 12 and the second main section 52 of the shipping container 10 forming the second side of the shipping container 10.

Closing the shipping container 10 in step S208 includes folding the shipping container 10 into a box about the product 12 with an inner surface of a first side (i.e., first main section 50) adhered to respective first sides 28 of the shock absorption members 14-24 and inner side of the second side of the box 10 (i.e., second main section 52) adhered to respective second sides 32 of the shock absorption members 16-24. Advantageously, the shipping container 10 includes at least one adhesive strip disposed thereon that adheres to another portion of the shipping container to maintain the shipping container in its box form. This allows the shipping container 10 and the packaging system and method disclosed herein to be used without further adhering products, such as glue, tape, etc.

In particular, adhesive strips 98 can be provided or disposed on the shipping container 10, particularly alongside tab 58 and end flaps 100,102 of the end tabs 60, 62 respectively. Peelable liners 104 can be provided over the adhesive strips 98 for preventing inadvertent adherence of the adhesive strips to an undesired object and/or location. This shipping container 10 and the adhesive strips 98 are particularly configured and/or oriented to permit ready folding and assembly of the shipping container 10 into a box as shown in FIG. 5.

More specifically, the end flaps 60, 62 are first folded along the fold lines 106,108. Similarly, side tab 66 can be folded along folding line 110. Next the second main section 52 and the side tab 64 can be folded over about respective fold lines 112,114 with end tabs 54,56 and side tab 58 tucked inside corresponding tabs 60,62,66. The peelable liner 104 can be removed from adhesive strip 98 on side tab 58 and the adhesive strip 98 of side tab 58 can be adhered to the side tab 66. Then, peelable liner 104 can be removed from adhesive strip 98 on end flap 100; then, end flap 100 adhered via adhesive strip 98 to the second main section 52 on an outer side thereof as shown in FIG. 5. In particular, end flap 100 is folded about fold line 116.

Figure 5:
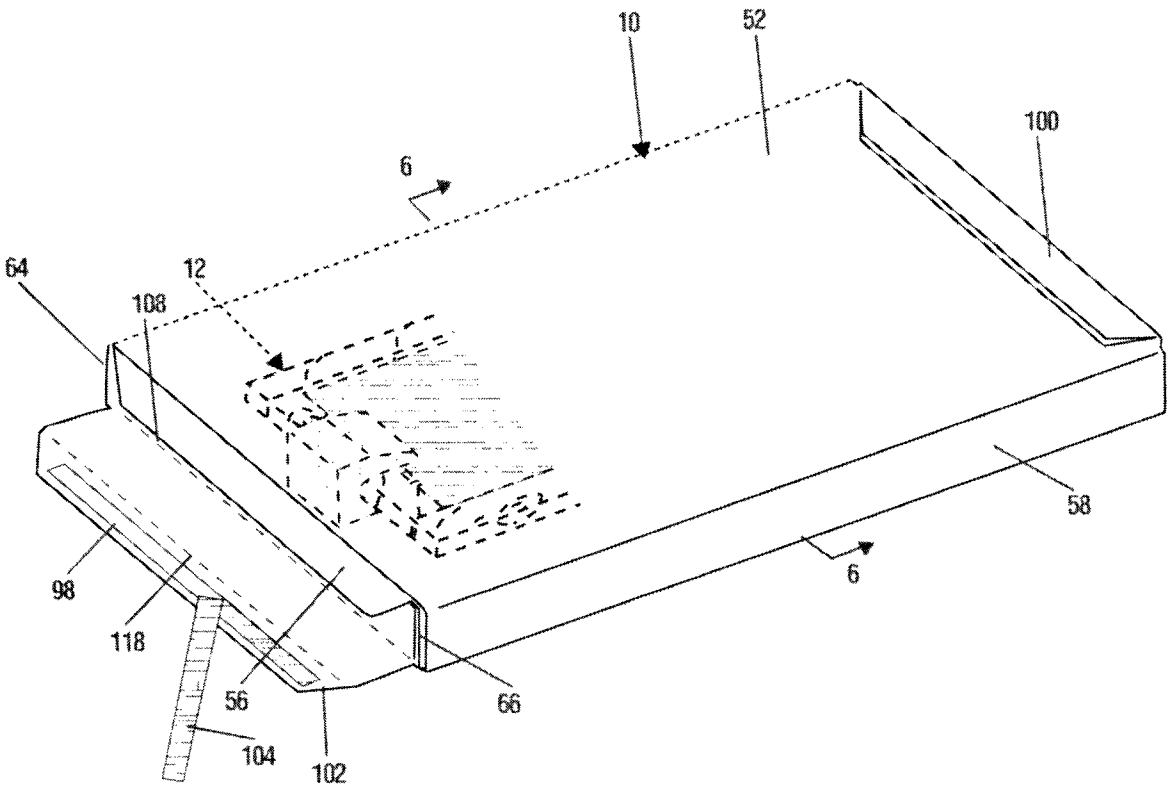
FIG. 5 is a perspective view of the shipping container of FIG. 4 shown being further closed about the product.

Similarly, as shown in FIG. 5, peelable liner 104 can be removed from the adhesive strip 98 of the end flap 102. Then, end tab 62 can be folded about fold line 108. End flap 102 can be folded about fold line 118 and secured by the adhesive strip 98 to the second main section 52 on an outside surface thereof to fully enclose the product 12 within the shipping container 10 formed as a box thereabout. As best shown in FIG. 6, the product 12 is suspended within the shipping container 10 formed as a box by the shock absorption members 16-26. As can be appreciated by those skilled in the art, the product 12 is also secured from movement within the shipping container 10. This prevents migration of the product 12 during shipping of the shipping container 10, such as toward the sides 54 or 58,66, as well as the ends, including first end 54,60 and second end 56,62. More specifically, the product 12 is secured in a central position and suspended on all sides thereof. This guards against drop damage of the shipping container 10 on all sides during shipping and handling thereof.

Figure 10:
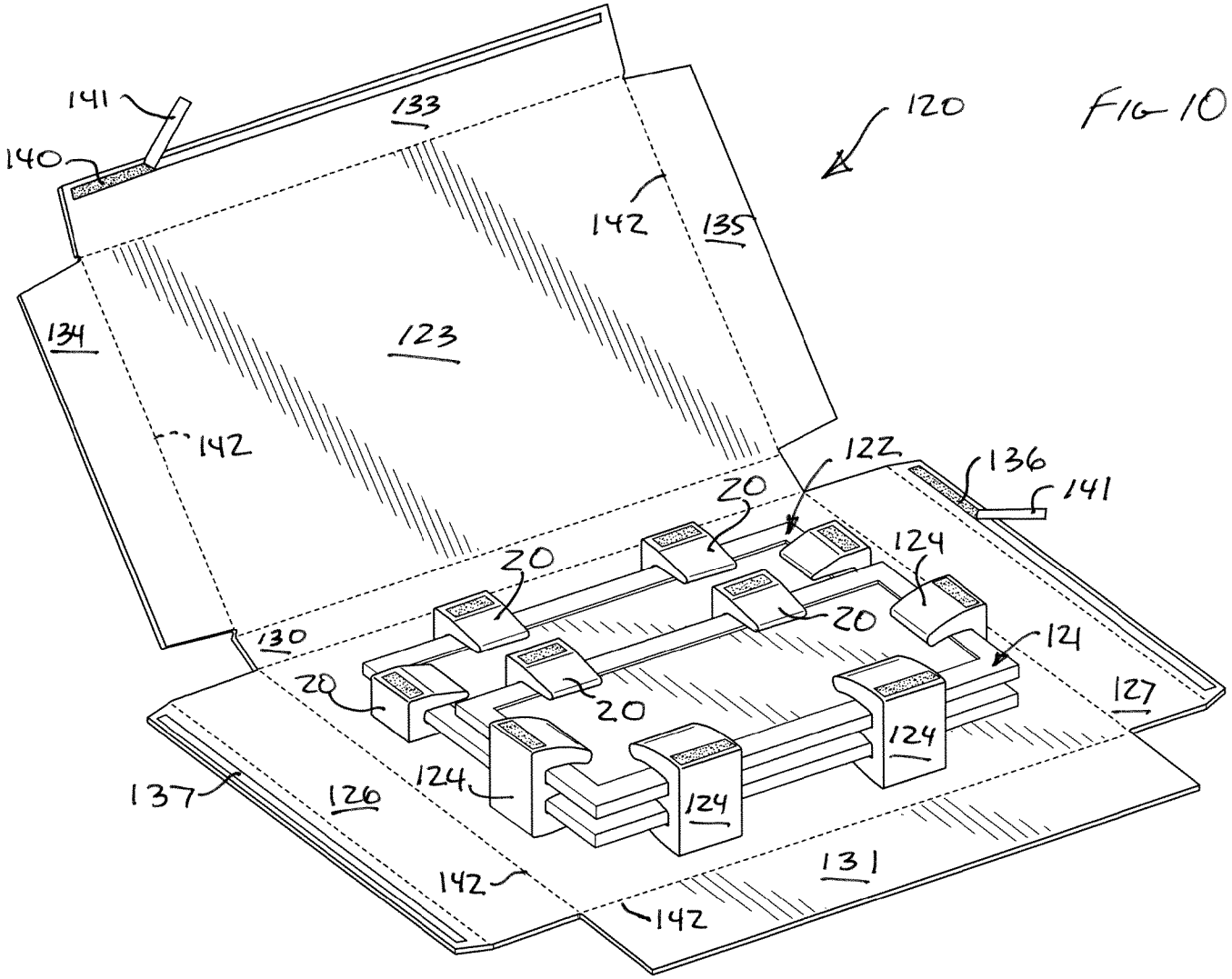
FIGS. 10 and 10A are perspective views of other embodiments of the invention in the context of a box blank.

FIG. 10 is a perspective view of another embodiment of the invention. FIG. 10 illustrates a box broadly designated at 120 with a first planar object 121 and a second planar object 122 inside the box 120. For clarity's sake, the box 120 is illustrated as an unfolded box blank. As set forth in the background, the first and second planar objects 121 and 122 are typically items that are easily broken or marred in transit such as furniture cabinet doors, including those that may include glass or other fragile portions. In the illustrated embodiment, the two planar objects have different dimensions from one another. In the case of items such as cabinet doors, the planar objects will have similar thicknesses, but different lengths, or different widths or different lengths and widths. The invention provides a superior packaging system for such differently sized objects.

As used herein, the term "planar" is not limiting, but instead refers to three dimensional objects for which the area is significantly greater than the thickness. Such objects are often, but not always, rectangular in shape. The difference between the size of an object in different dimensions is referred to as the "aspect ratio." In three dimensional items such as the planar objects described herein, the aspect ratio is still defined as the ratio of two of the three dimensions. For example, cabinet doors typically have an aspect ratio of at least 10:1, often at least 20:1, and sometimes 30:1 or greater. Stated differently, a cabinet door that is about 1 inch thick and 20 inches long on it's longest side has an aspect ratio of about 20:1.

Two types of shock absorbing polymer foam clips are attached to the planar objects 122 and 121 in the box 120. The first are the C-shape gripping clips illustrated in FIGS. 1-9 at numerals 14, 16, 18, 20, 22, and 24. (Reference numeral 20 will be used further herein for convenience and clarity). The second type of shock absorbing polymer foam clips are the E shaped clips 124. In this embodiment, at least one of the first C-shaped clips 20 is fastened to the first planar object 121. When the top panel 123 of the box 120 is folded over, the first clip 20 will be positioned between that wall panel 123 of the box 120 and the second planar object 122.

Additionally, at least one (and preferably several) of the second E-shape clips 124 are fastened to both of the planar objects 121 and 122 and are positioned between the opposite walls 123 and 125 of the box 120.

As FIG. 10 illustrates the combination of the C-shape gripping clips 20 and the E-shape gripping clips 124 permits planar objects of different sizes to be packaged together securely, safely, and with sufficient cushioning to minimize or eliminate damage in transit. In particular, the E-shape clips 124 grip both planar objects and adhere to opposite walls of the box 120, and the C-shape clips 20 grip one of the planar objects and adhere to one of the walls of the box.

If desired in some circumstances, the C-shape clips 20 can be made relatively thick so that they have a width (i.e., across-the-box) dimension substantially similar to the width of the E-shape clips.

The C-clips 20 and E-clips 124 are formed of a material that is compressible and resilient, typically polymer foam. Appropriate foams for the package are well understood in the art and can be selected by the skill person without undue experimentation. Exemplary polymers include polyurethane, polyolefin, polyvinylchloride, styrene, polyimides, and silicone.

The invention can accordingly be understood as a package precursor that includes the box blank 120, the C-shaped clip (or clips) 20 fixed on one panel (here 125) of the box blank 120, an E-shaped clip (preferably several) fixed on the same panel 125 of the box blank 120, and the planar objects 121 and 122. The first planar object 121 is inserted into at least one E-shape clip 124 and at least one C-shaped clip 20, and the second planar object 122 is inserted into at least one E-shaped clip 124 and a second C-shape clip with the second C-shape clip gripping the first planar object.

As FIG. 10 illustrates, the box blank 120 has sufficient panels to define a rectangular solid. These include the two largest panels 123 and 125, two end panels 126 and 127, and the two smaller side panels 130 and 131 (defined by the dotted lines in the drawing). In the particular box illustrated, additional folding tabs are included with a tab 133 positioned to overlie the smaller side panel 131 and tabs 134 and 135 which respectively overlie the end panels 126 and 127.

In most circumstances, the box 120 is formed of corrugated board because of its wide availability, appropriate cost, and well understood properties and strengths. Other materials could be incorporated, however, including combinations of board and polymer. An advantage of the invention, however, is that it provides a very secure cushioning package within a generally otherwise conventional corrugated board box.

As in earlier described embodiments, the box blank 120 can be assembled and closed using respective adhesive strips 136 (on end panel 127), 137 (on end panel 126), and 140 (on tab 133).

As further illustrated in FIG. 10 (and in the previous embodiments), the adhesive areas 136, 137 and 140 are typically initially covered with a release strip, each of which is noted at 141. Similar adhesive and release strips reps are on the clips 20 and 124 and will be described with respect to FIGS. 12-14.

FIG. 10 also illustrates that the box blank 120 includes a plurality of fold lines generically designated at 142 which define the blank 120 in the usual well-understood manner.

Figure 10A:
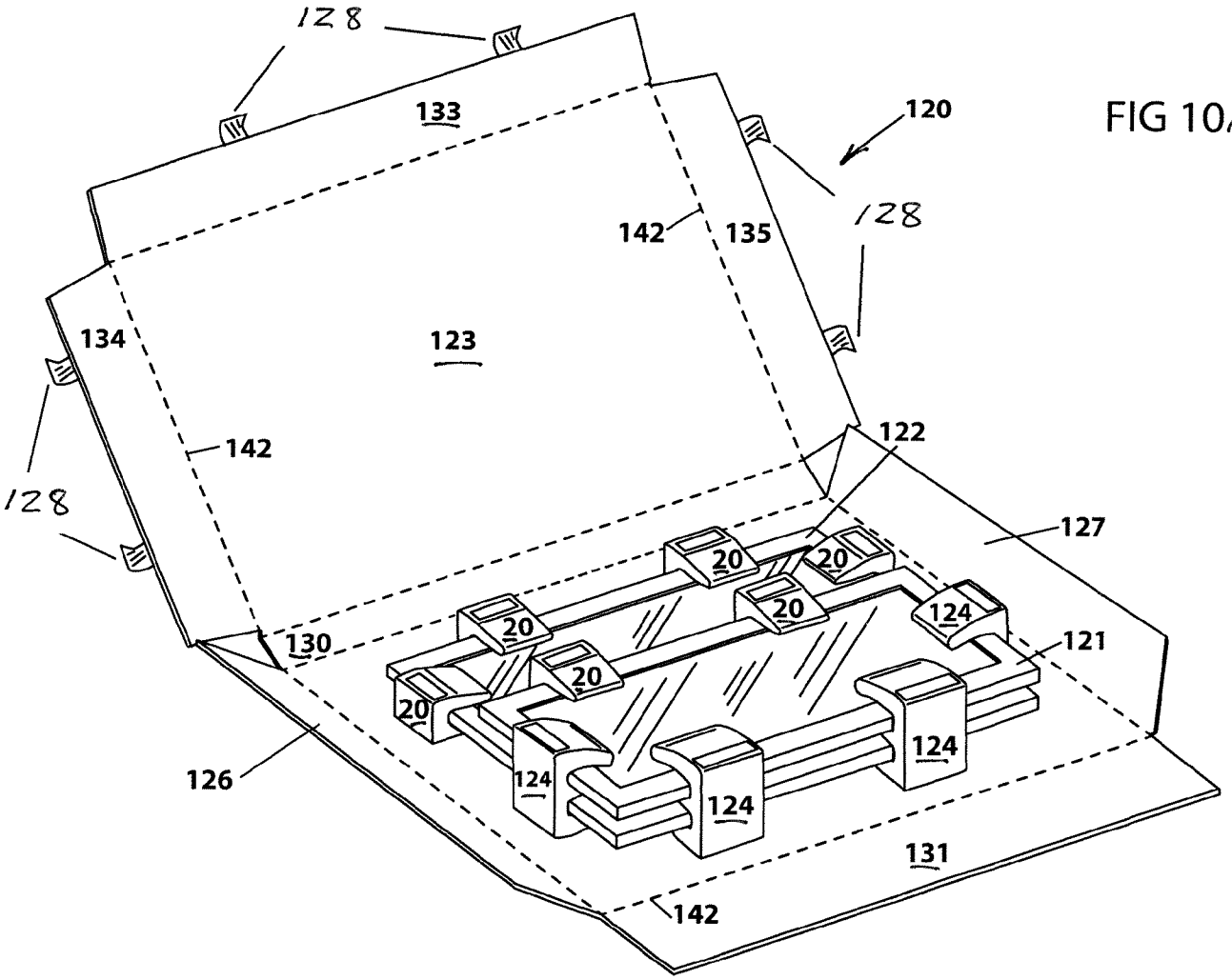

FIG. 10A shows an embodiment similar to that in FIG. 10, but with a plurality of clip tape pieces 128 used to close the tabs of the box 120 instead of the adhesive strips illustrated in FIG. 10. The use of the clip tape pieces 128 is consistent with the workstation embodiment of the invention illustrated in FIGS. 14-18. The remaining items in FIG. 10A are the same as illustrated in FIG. 10, and carry the same numerals.

The term "box" is, of course, well understood in this and other arts, and generally refers to a six sided solid rectangle. This is the sense in which it is generally used herein. Formal geometry terms for such shapes include "orthotope" or "hyperrectangle."

Figure 11:
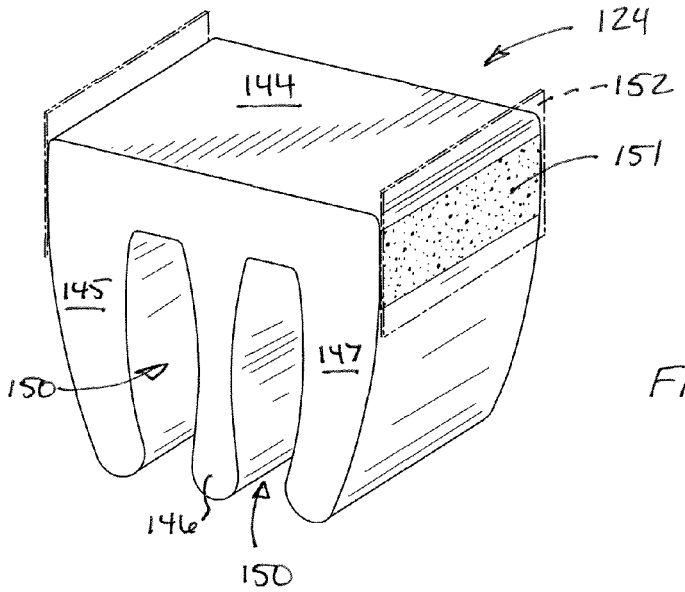
FIG. 11 is a perspective view of a gripping clip according to the present invention.
Figure 12:
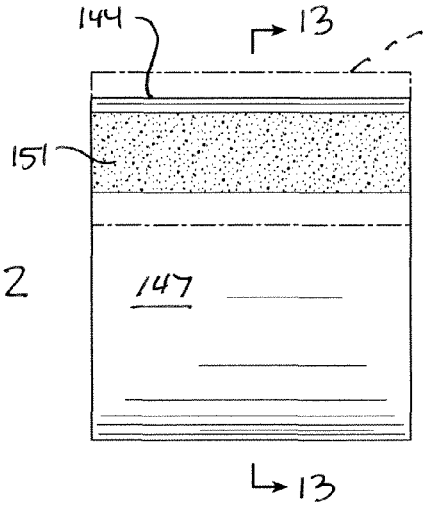
FIG. 12 is a side elevation old view of the gripping clip of FIG. 11.
Figure 13:
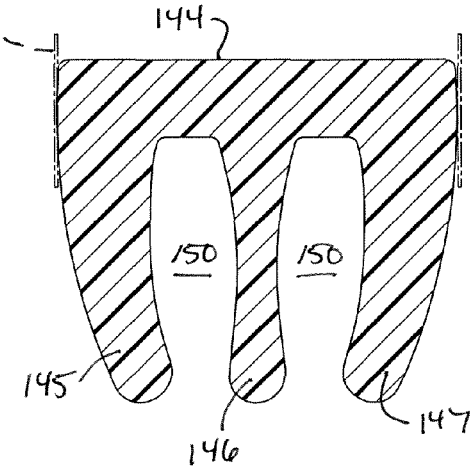
FIG. 13 is a cross-sectional view of the gripping clip taken along lines 13-13 of FIG. 12.

FIGS. 11, 12, and 13 illustrate the E-shape gripping clip in greater detail. FIG. 11 is a perspective view, FIG. 12 is a side elevational view, and FIG. 13 is a cross-sectional view taken along lines 13-13 of FIG. 12.

Each clip 124 includes a base wall 144 and three clamping walls 145 146 and 147. The clamping walls are oriented generally perpendicularly to the base wall 144 and comprise two exterior clamping walls 145 and 147 and one interior clamping wall 146. These clamping walls define two gripping slots each numbered at 150 between the respective exterior clamping walls 145, 147 and the interior clamping wall 146. In other words, the gripping slots 150 are on either side of the interior wall 146.

The shape and orientation of the walls and the slots can be similar to those described with respect to the C-shaped embodiments 16, 18, 20, 22 and 24. The shape and relationship of the base wall 144 and the clamping walls 145, 146, 147 is such that the designation "E-shape" is a convenient and illustrative manner of referring to the clip.

The cushioning and gripping clip 124 also includes an adhesive strip 151 along at least one of the exterior clamping walls, and preferably both of the exterior clamping walls, immediately adjacent the base wall 144. Each of the adhesive strips 151 typically include a peelable release liner 152 covering the adhesive strip 151 which protects the adhesive from contacting anything other than an intended item until the clip 124 is ready for use. Adhesive strips of this type are well known in the art, and are typically formed of a material that will stick to the adhesive strip 151, but will either minimize or entirely avoid removing any of the adhesive as the release liner is removed. Release liner materials can be selected by those of skill in this art without undue experimentation. Appropriate adhesives suitable for joining both paper and polymer foam are generally well understood by persons of skill in this art and thus can be selected and used without undue experimentation.

As set forth with respect to the other illustrated embodiments, the cushioning gripping clip 124 is preferably formed of polymer foam, and the foam is typically selected from the group consisting of polyurethane, polyolefin, polyvinylchloride, styrene, polyimides, and silicone.

The foam is selected to have a desired density, and in some cases is selected to have as low a density as possible consistent with the required mechanical strength. Depending upon the application, the foam can have an open or closed cell structure. In this regard, in an "open cell" foam essentially all (i.e., at least about 90 percent), of the cells are intercommunicating. Rigid foams may have varying density values and usually have a closed cell structure.

FIGS. 14-18 illustrate another embodiment of the invention.

Figure 14:
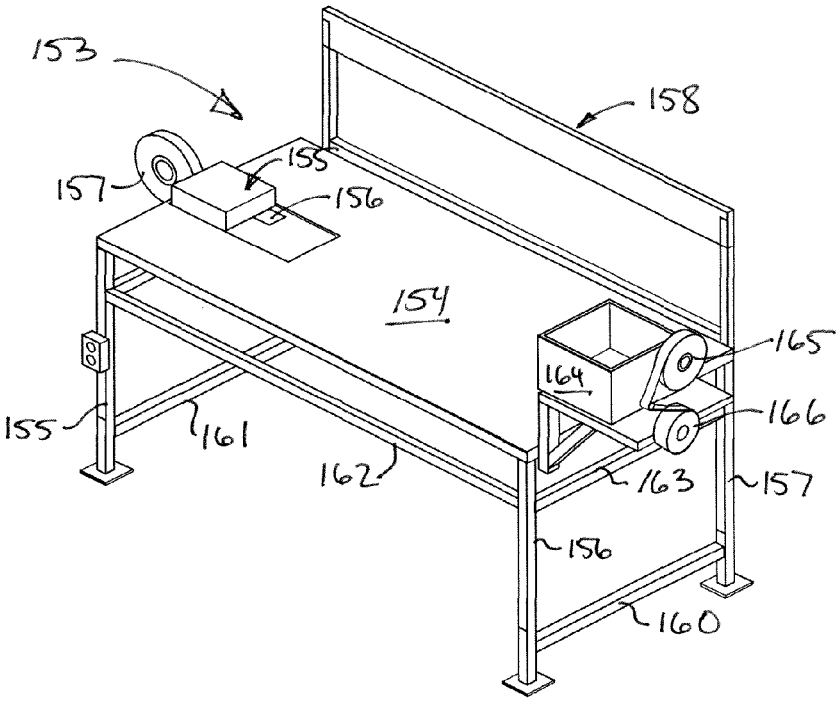
FIG. 14 is a perspective view of a workstation according to the invention.

FIG. 14 is a perspective view of a packaging station according to the invention and broadly designated at 153.

Figure 15:
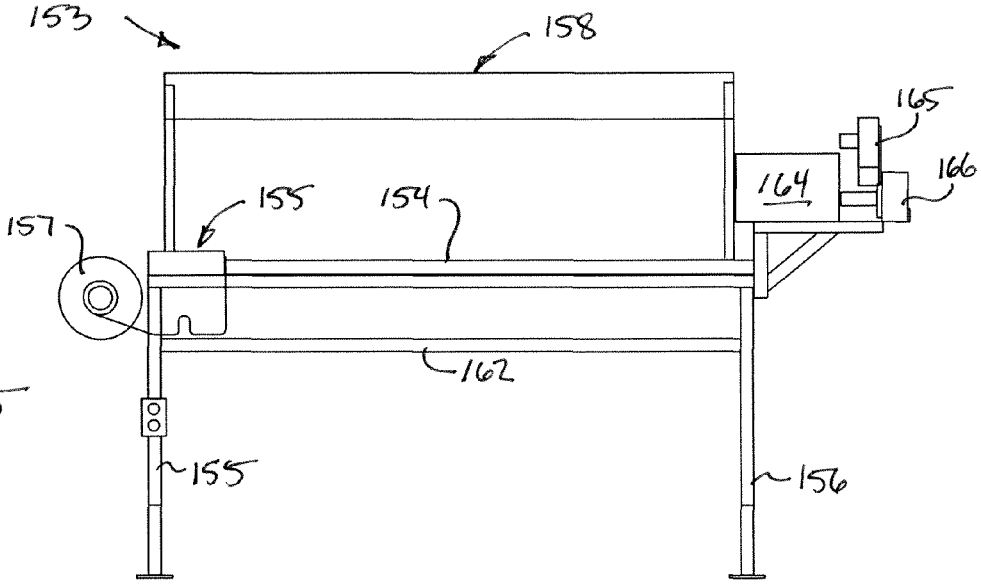
FIG. 15 is a front elevation overview of the workstation of FIG. 15.

The packaging station 153 includes a horizontal work surface 154 elevated (i.e. with respect to a floor) on four legs, three of which are illustrated at 155, 156, and 157 in FIG. 15. The illustrated embodiment also includes respective horizontal cross braces 160, 161, 162 and 163. If desired, the legs and cross braces can form a vertical panel broadly designated at 158.

A switch-based taping machine broadly designated at 155 is substantially coplanar with the work surface 154 so that packages on the work surface 154 can engage a switch 156 on the taping machine 155 without requiring lifting packages from the work surface 154.

Other than its specific orientation, the tape machine 155 can be a commercial device of which a number of choices are available to the skilled person without undue experimentation. Without going into unnecessary detail, a basic tape machine 155 will include an axle to hold a tape roll 157, the previously noted switch 156, a knife or functional equivalent to cut discrete portions of tape from the roll 157, and a motor to feed a cut piece of tape on to an adjacent package when the package bears against the switch 156.

A supply container 164 is mounted on one edge of the horizontal work surface 154. A second tape dispenser illustrated by the two rolls 165, 166 and the pulley 167 is adjacent the supply container 164 and typically is used to keep items being packaged convenient for the packaging station operator. In the context of (e.g.) cabinet doors or related furniture which will later be assembled into a larger structure, the supply container 164 typically holds a plurality of fasteners or small hardware items which in many circumstances are conveniently packaged in small sets in small plastic bags. Thus, when packaging items such as cabinet doors, the operator can quickly obtain a bag of parts from the supply container 164, apply tape from the rolls 165, 166, and tape the bag into a package being assembled on the work surface 154.

Figure 16:
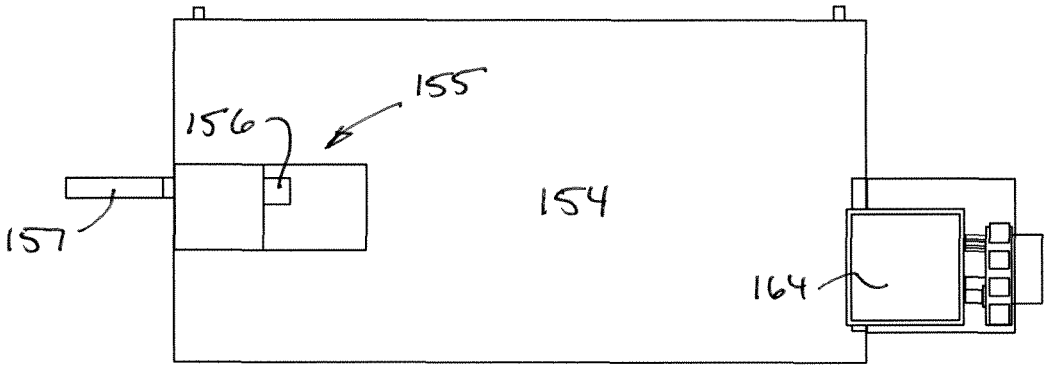
FIG. 16 is a top plan view of the workstation.
Figure 17:
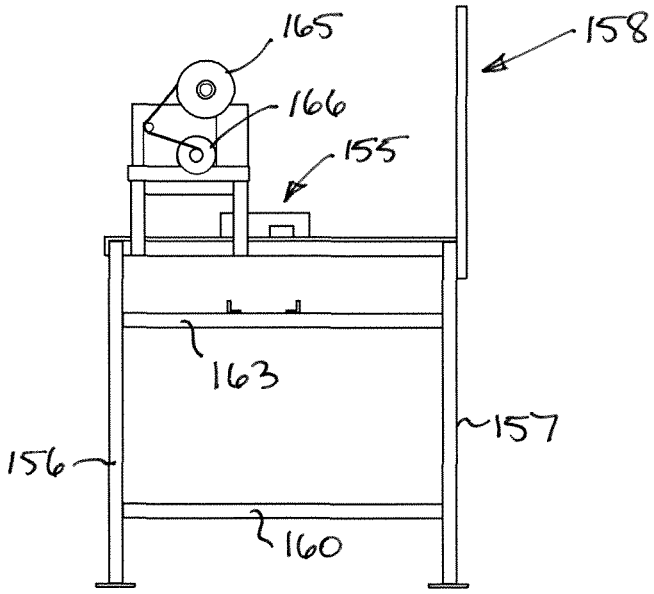
FIG. 17 is a side elevation overview of the workstation.

FIGS. 15, 16, and 17 show all of these elements in respective elevational views.

Figure 18:
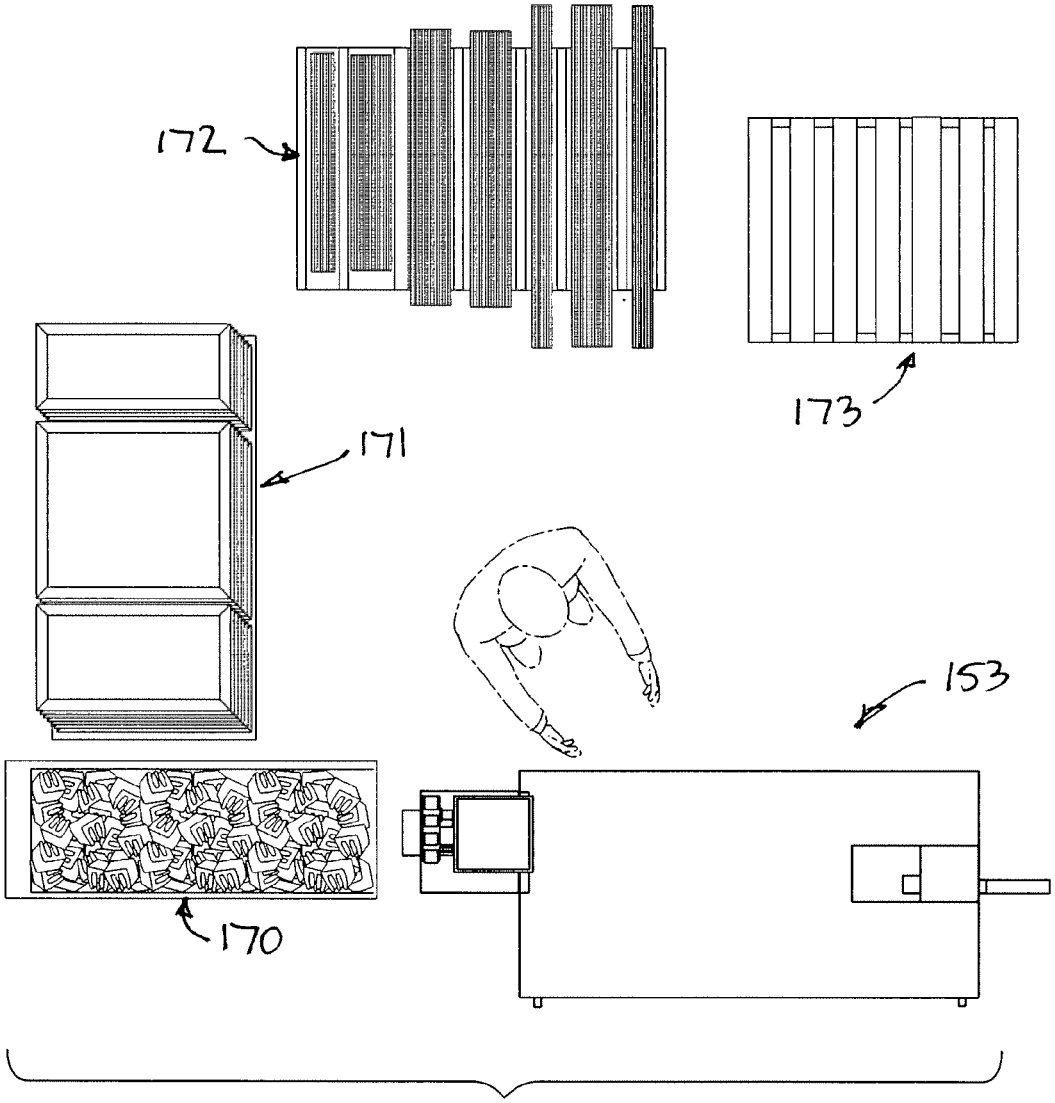
FIG. 18 is a perspective view of the workstation in conjunction with the packaging supplies and items with which it is used.

FIG. 18 shows the packaging station 153 in its environmental context. In the illustrated embodiment, a container 170 provides a supply of gripping clips (illustrated as the E-shape clips 124) adjacent the packaging station 153. Also, a supply of objects to be packaged, shown as the stacks of cabinet doors 171, is within appropriate reach of the operator, and is further accompanied by a supply of box blanks 172 that are likewise conveniently located with respect to the operator. Finally, a loading pallet 173 is adjacent the workstation 153 so that taped and completed packaged items can be easily positioned by the operator for movement, shipping, and eventual delivery to a customer.

Although all of the functions of the packaging station 153 and the associated items illustrated in FIG. 18 can be fully automated, such fully automated devices are expensive, take up a great deal of space, and generally are less economically feasible for smaller or certain custom packaging needs. The workstation of the invention provides a compact, economical, and functionally efficient structure for taking advantage of the foam clips of the invention for such smaller and custom users.

In the drawings and specification there has been set forth a preferred embodiment of the invention, and although specific terms have been employed, they are used in a generic and descriptive sense only and not for purposes of limitation, the scope of the invention being defined in the claims.

The invention claimed is:

1. A package combination, comprising:
a box having wall panels coupled by a side panel;
first and second planar objects disposed in said box; and
first and second shock absorbing clips attached to said first and second planar objects in said box,
wherein said first clip has a base wall and two clamping walls oriented generally transverse with said base wall, said two clamping walls defining a gripping slot between said two clamping walls, each of said two clamping walls having an exterior side surface, and an adhesive strip disposed on each of said exterior side surfaces immediately adjacent to said base wall, and
wherein said second clip has a base wall and three clamping walls oriented generally transverse with said base wall, said three clamping walls including two exterior clamping walls and one interior clamping wall, said three clamping walls defining two gripping slots, each of said two exterior clamping walls having an exterior side surface, and an adhesive strip disposed on each of said exterior side surfaces immediately adjacent to said base wall;
said first clip fastened to said second planar object and said two clamping walls of said first clip are positioned between said side panel of said box and said first planar object; and
said second clip fastened to both said first and second planar objects and said three clamping walls of said second clip are positioned between said wall panels of said box.

2. The package combination according to claim 1, wherein said first and second clips are compressible.

3. The package combination according to claim 2, wherein said first and second clips are polymer foam.

4. The package combination according to claim 3, wherein said polymer is selected from the group consisting of polyurethane, polyolefin, polyvinyl chloride, styrene, polyimide, and silicone.

5. The package combination according to claim 1, wherein said planar objects have an aspect ratio of at least 10:1 between their shortest and longest dimensions.

6. The package combination according to claim 1, wherein said planar objects have an aspect ratio of at least 20:1 between their shortest and longest dimensions.

7. The package combination according to claim 1, wherein said planar objects are formed from a material selected from the group consisting of wood, glass, and combinations of wood and glass.

8. The package combination according to claim 1, wherein said first clips are C-shape clips and said second clips are E-shape clips.

9. The package combination according to claim 8, comprising four E-shape clips and two C-shape clips.

10. The package combination according to claim 9, wherein:
said E-shape clips grip both planar objects and adhere to said opposite wall panels of said box; and
said C-shape clips grip said second planar object and adhere to one of said wall panels of said box.

11. The package combination according to claim 1, wherein said wall panels are secured closed with clip tape.

12. The package combination according to claim 1, wherein said wall panels are secured closed with adhesive strips.

13. A package precursor, comprising:
a box blank having wall panels coupled by a side panel;
a first C-shaped clip;
a second C-shaped clip fixed on one of said wall panels of said box blank;
an E-shaped clip fixed on said one of said wall panels of said box blank;
a first planar object inserted into said E shaped clip and said first C-shaped clip; and
a second planar object inserted into said E-shaped clip and said second C-shaped clip,
wherein each of said first C-shaped clip and said second C-shaped clip has a base wall and two clamping walls oriented generally transverse with said base wall, said two clamping walls defining a gripping slot between said two clamping walls, each of said two clamping walls having an exterior side surface, and an adhesive strip disposed on each of said exterior side surfaces immediately adjacent to said base wall,
wherein one of the two clamping walls of the first C-shaped clamp is further disposed between the first planar object and the second planar object, and
wherein said E-shaped clip has a base wall and three clamping walls oriented generally transverse with said base wall, said three clamping walls including two exterior clamping walls and one interior clamping wall, said three clamping walls defining two gripping slots, each of said two exterior clamping walls having an exterior side surface, and an adhesive strip disposed on each of said exterior side surfaces immediately adjacent to said base wall.

14. The package precursor according to claim 13, wherein said wall panels are sufficient to define a rectangular solid.

15. The package precursor according to claim 13, wherein said box is corrugated board.

16. The package precursor according to claim 13, wherein said first and second C-shaped clips and said E-shaped clips are polymer foam.

17. The package precursor according to claim 13, wherein said box blank includes adhesive tabs.

18. The package precursor according to claim 13, further comprising multiple E-shaped clips and multiple C-shaped clips.

19. A cushioning clip, comprising:

a base wall and three clamping walls oriented generally transverse with said base wall; and said three clamping walls including two exterior clamping walls and one interior clamping wall, said three clamping walls defining two gripping slots, each of said two exterior clamping walls having an exterior side surface, and an adhesive strip disposed on each of said exterior side surfaces immediately adjacent to said base wall, wherein each of said exterior side surfaces has an arcuate profile curved inwardly toward said interior clamping wall.

20. The cushioning clip according to claim 19, comprising a peelable liner on each said adhesive strip.

21. The cushioning clip according to claim 19, comprising polymer foam.

22. The cushioning clip according to claim 21, wherein said foam is selected from the group consisting of: polyurethane, polyolefin, polyvinyl chloride, styrene, polyimide, and silicone.

* * * * *